US011280180B2

(12) United States Patent
Wang et al.

(10) Patent No.: US 11,280,180 B2
(45) Date of Patent: Mar. 22, 2022

(54) PORTABLE IN-SITU GAS PRESSURE MEASURING DEVICE FOR SHALLOW GAS-BEARING STRATUM AND MEASURING METHOD THEREOF

(71) Applicant: Institute of Rock and Soil Mechanics, Chinese Academy of Sciences, Hubei (CN)

(72) Inventors: Yong Wang, Hubei (CN); Lingwei Kong, Hubei (CN); Kaiwen Chen, Hubei (CN); Fuxue Sun, Hubei (CN); Haoqiang Li, Hubei (CN); Bijun Chen, Hubei (CN)

(73) Assignee: INSTITUTE OF ROCK AND SOIL MECHANICS, CHINESE ACADEMY OF SCIENCES, Hubei (CN)

( * ) Notice: Subject to any disclaimer, the term of this patent is extended or adjusted under 35 U.S.C. 154(b) by 0 days.

(21) Appl. No.: 17/085,159

(22) Filed: Oct. 30, 2020

(65) Prior Publication Data

US 2021/0131271 A1 May 6, 2021

(30) Foreign Application Priority Data

Nov. 1, 2019 (CN) ..... 201911061618.8

(51) Int. Cl.

| | |
|---|---|
| ***E21B 49/08*** | (2006.01) |
| ***E21B 47/10*** | (2012.01) |
| ***E21B 49/00*** | (2006.01) |

(52) U.S. Cl.

CPC ..... *E21B 47/10* (2013.01); *E21B 49/005* (2013.01); *E21B 49/087* (2013.01)

(58) Field of Classification Search

CPC ... E21B 49/087; E21B 49/088; E21B 49/0875

See application file for complete search history.

(56) References Cited

U.S. PATENT DOCUMENTS

| | | | | |
|---|---|---|---|---|
| 6,062,073 | A * | 5/2000 | Patton | E21B 23/02 166/100 |
| 8,151,878 | B2 * | 4/2012 | Georgi | E21B 49/10 166/264 |
| 9,347,314 | B2 * | 5/2016 | Indo | E21B 47/113 |
| 9,670,775 | B2 * | 6/2017 | Tjhang | E21B 49/10 |
| 10,378,349 | B2 * | 8/2019 | Ritzmann | E21B 49/08 |
| 10,635,760 | B2 * | 4/2020 | Chok | G06F 30/20 |
| 2014/0278113 | A1 * | 9/2014 | Chok | E21B 49/088 702/13 |

* cited by examiner

*Primary Examiner* — Shane Bomar

(74) *Attorney, Agent, or Firm* — Tutunjian & Bitetto, P.C.

(57) ABSTRACT

The disclosure relates to the field of geotechnical engineering investigation in the civil engineering field. A portable in-situ gas pressure measuring device for a shallow gas-bearing stratum and a measuring method thereof are provided, the device includes a static cone penetrometer, a pressure-sensor control system, a static cone penetration rod and a probe. The static cone penetrometer is connected with the static cone penetration rod, the static cone penetration rod is connected with the probe; the probe is connected with the pressure-sensor control system. The portable in-situ pressure measuring device for a shallow gas-bearing stratum has simple structure and clear principle and is conveniently assembled and disassembled and easy to popularize and provides a measuring method.

17 Claims, 2 Drawing Sheets

PORTABLE IN-SITU GAS PRESSURE MEASURING DEVICE FOR SHALLOW GAS-BEARING STRATUM AND MEASURING METHOD THEREOF

CROSS REFERENCE TO RELATED APPLICATION

This application claims the priority of Chinese Patent Application No. 201911061618.8 entitled "PORTABLE IN-SITU GAS PRESSURE MEASURING DEVICE FOR SHALLOW GAS-BEARING STRATUM AND MEASURING METHED THEREOF" filed with the Chinese Patent Office on Nov. 1, 2019, which is incorporated herein by reference in its entirety.

TECHNICAL FIELD

The application relates to the field of geotechnical engineering investigation in the field of civil engineering, and relates to an in-situ gas pressure measuring device and method, in particular to a portable in-situ gas pressure measuring device for a shallow gas-bearing stratum and a measuring method thereof.

BACKGROUND ART

Shallow gas generally refers to natural gas (including organic, inorganic or multi genetic gas) buried within 1500*m* below the surface of the earth. Strata rich in shallow gas are referred to as gas-bearing Strata. A Gas-bearing stratum is generally distributed in marsh wetlands, estuaries, deltas, lakes, and seabed sediments, as well as shallow ground containing relatively rich oil and gas resources. The gas in the soil layer mainly comes from biogenic gas which is formed by decomposing organic matter through anaerobes, deep oil and gas, mantle gas, and gas which is generated in magmatic activity, migrated upward through leakage and diffusion and sealed in the shallow ground. Shallow gas is stored to different degrees in the coastal areas of Jiangsu and Zhejiang, Yangtze river Delta, Tsaidam Basin, Songliao basin, Bohai Bay basin and small and middle-sized basins in Guizhou-Guangdong-Yunnan-Guangxi area in south China, and the shallow gas in the southeast coastal areas, the middle and lower areas of Yangtze river including Jiangsu, Zhejiang, Sanghai, Fujian, Guangdong, Hainan, Hunan, Hubei, Jiangxi and the like is mainly distributed in the coastal plains and the plains along the river in the Quaternary System. For civil engineering, the gas-bearing stratum may cause a special engineering geological disaster, i.e., a shallow gas geological disaster. In the famous construction of Hangzhou Bay Bridge in China, an accident had occurred that shallow gas suddenly burst and burnt, resulting in damage to ships and injury to people. Other countries have also seen accident that offshore drilling platform is overturned due to the burst of gas in the gas-bearing soil layer. With the further development of underground space in China, more and more engineering constructions propably encountered the underground shallow gas, and thus the problem of the shallow gas geological disaster become more prominent. When a project encounters the gas-bearing stratum, information about gas source, component, main storage layer position, distribution range, gas content, gas pressure in the gas-bearing stratum firstly needs to be ascertained. In this case, the magnitude of the gas pressure in an in-situ soil body in the gas-bearing stratum is important for accurately evaluating a disaster degree of a shallow gas-bearing stratum to the construction.

At present, geotechnical engineering investigation in geological regions containing the shallow gas mostly depends on in-situ static cone penetration, drilling or professional equipment belonging to a petroleum and natural gas department. However, currently, there is no portable investigation device for measuring an in-situ gas pressure in the gas-bearing stratum.

SUMMARY

In order to solve the technical problems in the background art, some embodiments of the present disclosure provides a portable in-situ gas pressure measuring device for a shallow gas-bearing stratum and a measuring method thereof, which have simple structure and clear principle, and are conveniently assembled and disassembled operation and easy to popularize.

In order to achieve the purpose, some embodiments of the present disclosure adopts the following technical scheme.

A portable in-situ gas pressure measuring probe for a shallow gas-bearing stratum includes a gas collection part and a gas pressure measuring part which is coaxially connected with and communicated with the gas collection part.

In some embodiments, the gas collection part adopted by the present disclosure includes a conical head, a porous metal tube, a cylindrical permeable stone and a sealing rubber gasket. the conical head is connected with the porous metal tube; the cylindrical permeable stone is sleeved on the porous metal tube; the sealing rubber gasket is arranged between a top of the cylindrical permeable stone and the gas pressure measuring part; a side wall of the porous metal tube is provided with circular apertures penetrating through the side wall; the circular apertures are communicated with an inner cavity of the gas pressure measuring part through the hollow porous metal tube.

In some embodiments, the gas collection part adopted by the present disclosure further includes a first thread arranged at a top of the porous metal tube; the porous metal tube is connected with the gas pressure measuring part via the first thread.

In some embodiments, the gas pressure measuring part adopted by the present disclosure includes a first probe outer shell, a wire, a sealed rubber bag and a film sensor; the first probe outer shell is a hollow cavity structure; the sealed rubber bag is arranged in an inner cavity of the first probe outer shell; the inner cavity of the sealed rubber bag is filled with mineral oil; the film sensor is arranged in the inner cavity of the sealed rubber bag and is immersed in the mineral oil; the wire passes through the first probe outer shell and is connected with the film sensor; the first probe outer shell is connected with the gas collection part and communicated with the gas collection part.

In some embodiments, the gas pressure measuring part also includes a second thread arranged at a bottom of the first probe outer shell; the second thread is connected to the first thread of the gas collection part.

In some embodiments, the gas pressure measuring part adopted by the present disclosure also includes a sealed-rubber-bag connecting thread which is arranged at a top of the first probe outer shell and is used for being connected with the sealed rubber bag; and a film-sensor connecting thread connected with the film type sensor; the sealed rubber bag is arranged inside the first probe outer shell via the sealed-rubber-bag connecting thread; the film sensor is arranged at the top of the first probe outer shell via the film-sensor connecting thread and is arranged inside the sealed rubber bag.

A portable in-situ gas pressure measuring device for a shallow gas-bearing stratum based on the portable in-situ gas pressure measuring probe for a shallow gas-bearing stratum as aforesaid, includes a static cone penetrometer, a pressure-sensor control system, a static cone penetration rod and the probe as mentioned above; the static cone penetrometer is connected with the static cone penetration rod; the static cone penetration rod is connected with the probe; the probe is connected with the pressure-sensor control system.

In some embodiments, the pressure-sensor control system adopted by the present disclosure includes a pressure-sensor control device and a wire; the probe is connected with the pressure-sensor control device via the wire.

In some embodiments, the portable in-situ gas pressure measuring device for a shallow gas-bearing stratum adopted by the present disclosure further includes an adapter part arranged between the gas pressure measuring part and the static cone penetration rod; the adapter part includes a second probe outer shell, a drill-rod connection thread and a fourth thread; the second probe outer shell is connected with a top of the gas pressure measuring part via the fourth thread; the second probe outer shell is connected with a bottom of the static cone penetration rod via the drill-rod connecting thread.

A measuring method based on the portable in-situ gas pressure measuring device for a shallow gas-bearing stratum, includes the following steps:

assembling a probe, including:

connecting a porous metal tube with a conical head, sleeving a cylindrical permeable stone on the porous metal tube, sleeving a sealing rubber gasket on the porous metal tube so that the sealing rubber gasket is positioned at a top of the cylindrical permeable stone;

connecting a wire with a film pressure sensor, and inserting the connected film pressure sensor into a sealed rubber bag, fixing the sealed rubber bag and the film pressure sensor inside a first probe outer shell, filling the sealed rubber bag with mineral oil after air in the sealed rubber bag is discharged by a vacuum pump;

connecting the first probe outer shell with the porous metal tube, passing the wire connected with the film pressure sensor through a second probe outer shell, and connecting the first probe outer shell with the second probe outer shell; and connecting the second probe outer shell with the static cone penetration rod via a adapter part, and completing the assembly of the probe;

assembling a measuring part, including:

passing the wire through the hollow static cone penetration rod to the ground, and connecting the wire with a pressure-sensor control device to prepare for a static cone penetration test; and measuring an in-situ gas pressure, including:

switching on a power supply after the probe and the static cone penetration rod are installed on a static cone penetrometer, activating the pressure-sensor control device, recording an initial pressure value $p_0$, and zeroing the pressure value;

penetration operation configured for performing a penetration at a penetration speed of 1 cm/s to 2 cm/s until the probe reach a determined gas-bearing soil layer, wherein soil particles are blocked outside by the cylindrical permeable stone, and water and gas in the gas-bearing soil layer can enter an inner cavity of the first probe outer shell through the cylindrical permeable stone of the probe and circular apertures of the porous metal tube, when the water and the gas do not enter any more, a pressure in the inner cavity of the probe is equal to a gas pressure of the gas-bearing soil layer, the pressure of a gas-water mixture in the inner cavity of the probe acts on the sealed rubber bag, and the pressure is uniformly transmitted to the film pressure sensor via the mineral oil;

detection operation configured for detecting and transferring by the film pressure sensor detected pressure signals to the pressure-sensor control device on a ground via the wire until data on the pressure sensor control device do not change any more, and recording a pressure value $P_1$ at this moment, as an in-situ pressure value in the gas-bearing soil layer;

repeating the penetration operation and the detection operation to obtain an in-situ gas pressure value in another gas-bearing soil layer located at a next depth.

Some embodiment of the present disclosure has the following advantages.

The present disclosure provides a portable in-situ gas pressure measuring device for a shallow gas-bearing stratum and a measuring method thereof; the measuring device includes a static cone penetrometer, a pressure-sensor control system, a static cone penetration rod and a portable in-situ gas pressure measuring probe for a shallow gas-bearing stratum. The portable in-situ gas pressure measuring probe for a shallow gas-bearing stratum includes a gas collection part, a gas pressure measuring part and a adapter part; the gas collection part includes a conical head, a porous metal tube, a cylindrical permeable stone and a sealing rubber gasket; the conical head is connected with the porous metal tube; the cylindrical permeable stone is sleeved on the porous metal tube; the sealing rubber gasket is arranged between the top of the cylindrical permeable stone and the gas pressure measuring part; the porous metal tube is provided with circular apertures penetrating through the side wall of the porous metal tube. the circular apertures are communicated with the inner cavity of the gas pressure measuring part through the hollow porous metal tube. The gas pressure measuring part includes a first probe outer shell, a wire, a sealed rubber bag and a film sensor. The first probe outer shell is a hollow cavity structure; the sealed rubber bag is arranged in the inner cavity of the first probe outer shell; the inner cavity of the sealed rubber bag is filled with mineral oil; the film sensor is arranged in the inner cavity of the sealed rubber bag and is immersed in the mineral oil. The wire passes through the first probe outer shell and is connected with the film sensor; the first probe outer shell is connected with the gas collection part and communicated with the gas collection part. The adapter part includes a second probe outer shell, a drill-rod connecting thread and a fourth thread. The bottom of the second probe outer shell is connected with the top of the gas pressure measuring part via the fourth thread, and the top of the second probe outer shell is connected with the bottom of the static cone penetration rod via the drill-rod connecting thread. When the measuring device provided by the present disclosure is used for measuring the gas pressure, the pressure sensor control device is activated, an initial pressure value $p_0$ is recorded, and then the pressure value is zeroed. A penetration process is started and the penetration speed of the probe is 1 cm/s to 2 cm/s. The penetration process is stopped when the probe reaches a predetermined gas-bearing soil layer. In this case, soil particles in the gas-bearing soil layer are blocked outside by the cylindrical porous stone, and water and gas in the gas-bearing soil layer can enter into the inner cavity of the first probe outer shell through the cylindrical porous stone and the circular apertures of the porous metal tube. When water and gas does not enter any more, the pressure of the inner cavity of a third component of the probe is equal to the gas pressure of the gas-bearing soil layer; the pressure of the gas-water mixture of the inner cavity in the third component of the probe acts on the sealed rubber bag, and the pressure is uniformly transmitted to the film pressure sensor via mineral oil. The film pressure sensor detects the gas pressure and the measured pressure signal is transmitted to the pressure-sensor control device on the ground through the wire until data on the pressure-sensor control device is not changed any more; and at this moment, the pressure value $p_1$ is recorded as an in-situ gas pressure value in the gas-bearing soil layer. The portable in-situ gas pressure measuring device for a shallow gas-bearing stratum and measuring method thereof provided by some embodiments of the present disclosure have the advantages that the device is simple in structure and easy to carry, and can be mounted on a common static cone penetrometer to obtain the gas pressure value of the soil layer in the gas-bearing stratum in site; and the device and method solve the problem that there is no a portable in-situ gas pressure measuring device for a shallow gas-bearing stratum in a geotechnical engineering investigation for a geological area containing shallow gas.

Figure 1:
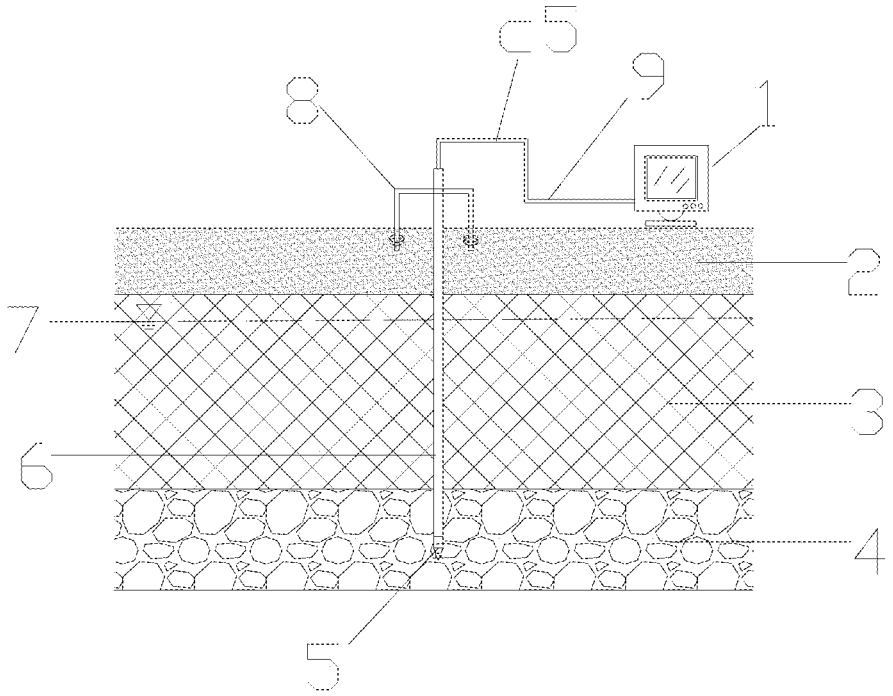
FIG. 1 is a schematic view of a overall structure of a portable in-situ pressure measurement device for shallow gas-bearing stratum according to the present disclosure.

List of reference numerals: 1 pressure-sensor control device; 2 miscellaneous filling soil layer; 3 gas sealing layer; 4 gas-bearing soil layer; 5 probe; 6 static cone penetration rod; 7 ground water level; 8 static cone penetrometer; 9 pressure-sensor control system; a1 conical head; a2 circular aperture; a3 first thread; a4 porous metal tube; b1 cylindrical permeable stone; b2 sealing rubber gasket; c1 second thread; c2 first probe outer shell; c3 mineral oil; c4 sealed-rubber-bag connecting thread; c5 wire; c6 film-sensor connecting thread; c7 sealed rubber bag; c8 film sensor; c9 third thread; d1 second probe outer shell; d2 drill-rod connecting thread; d3 fourth thread.

DETAILED DESCRIPTION OF THE EMBODIMENTS

Figure 2:
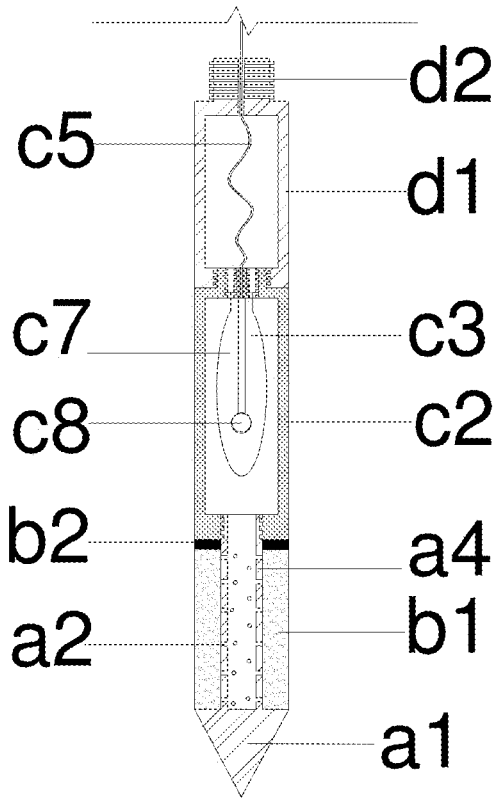
FIG. 2 is a schematic view of a overall structure of a probe employed in the present disclosure.
Figure 3:
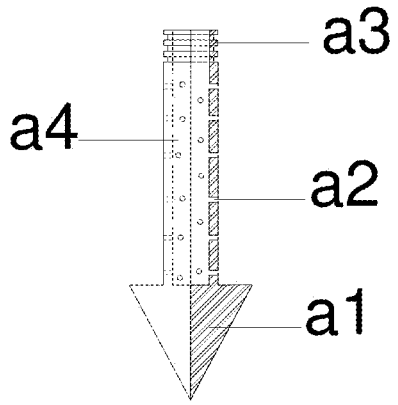
FIG. 3 is a schematic view of a construction of a first part of the probe employed in the present disclosure.

Referring to FIG. 2, the present disclosure first provides a portable in-situ gas pressure measuring probe for a shallow gas-bearing stratum, which is configured to include four components. Referring to FIG. 3, a first component includes a conical head a1, a porous metal tube a4, circular apertures a2 and a first thread a3; the conical head a1 mainly functions as a hard head when the probe 5 penetrates into the ground; an upper end of the conical head is connected with the porous metal tube a4; an outer surface of the porous metal tube a4 is tightly contacted with a cylindrical permeable stone b1 of a second component of the probe 5. Water and gas in the gas-bearing soil layer 4 can freely enter and exit the hollow porous metal tube a4 through the circular apertures a2 so as to enter into an inner cavity of a third component of the probe 5, and an upper end of the porous metal tube a4 is tightly connected with the third component of the probe 5 via the first thread a3. The main function of the first component of the probe 5 is to be penetrated into the ground, pass the water and gas in the gas-bearing soil layer 4 into the cavity of the third component of the probe 5, and be connected with the third component of the probe 5.

Figure 4:
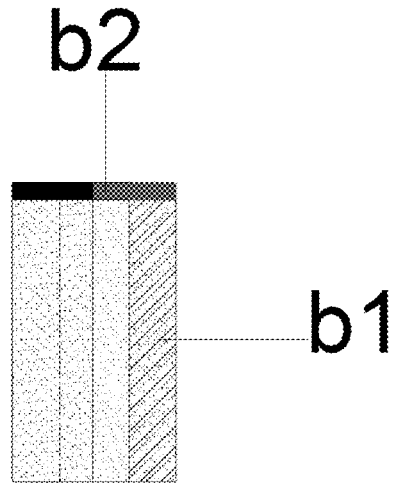
FIG. 4 is a schematic view of a construction of a second part of the probe employed in the present disclosure.

Referring to FIG. 4, the second component of the probe 5 includes the cylindrical permeable stone b1 and a sealing rubber gasket b2. The cylindrical permeable stone b1 is used for filtering out soil particles in the gas-bearing soil layer 4, so that underground water and gas in the gas-bearing soil layer 4 can flow through the circular apertures a2 of the first component of the probe 5, and freely pass into and out of an inner cavity of the porous metal tube a4. The cylindrical permeable stone b1 is sleeved on the porous metal tube a4 at an upper portion of the first component of the probe 5. The sealing rubber gasket b2 is located between an upper end of the cylindrical permeable stone b1 and a bottom of the first probe outer shell c2 of the probe 5; and mainly functions to seal the cylindrical permeable stone b1 and the bottom of the first probe outer shell c2 of the third component of the probe 5, and reduce the friction between the upper end of the cylindrical permeable stone b1 and the bottom of the first probe outer shell c2 of the third component of the probe 5. The main function of the second component of the probe 5 is to block soil particles in the gas-bearing soil layer 4, so that a mixture of the underground water and gas in the gas-bearing soil layer 4 can freely enter and exit the inner cavity of the porous metal tube a4 through the circular apertures a2, and is passed into the cavity of the third component of the probe 5 for storing the mixture of water and gas.

Figure 5:
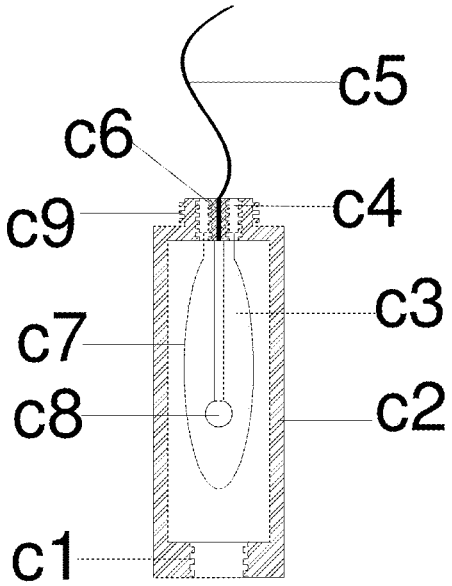
FIG. 5 is a schematic view of a construction of a third part of the probe employed in the present disclosure.

Referring to FIG. 5, the third component of the probe 5 includes a second thread c1, the first probe outer shell c2, mineral oil c3, a sealed-rubber-bag connecting thread c4, a wire c5, a film-sensor connecting thread c6, a sealed rubber bag c7, a film pressure sensor c8 and a third thread c9. The first probe outer shell c2 has a cavity therein; the second thread c1 at a lower end of the first probe outer shell c2 is connected with the first thread a3 located at the upper end of the porous metal tube a4 of the first component of the probe 5; and a third thread c9 at an upper end of the first probe outer shell c2 is tightly connected with a fourth thread d3 located at a lower end of a fourth component of the probe 5. The sealed rubber bag c7 has good elasticity, is preferably made of latex material; an oil inlet at an upper end of the sealed rubber bag c7 is engaged with a sealed-rubber-bag connecting thread c4; and the sealed rubber bag c7 is filled with mineral oil therein (a volume of the mineral oil is not compressible and is not influenced by temperature). The film pressure sensor c8 is immersed in the mineral oil c3 and is used for measuring a pressure transmitted by external fluid to the sealed rubber bag c7; an upper end of the film pressure sensor c8 is connected with a film-pressure-sensor connecting thread c6; and the film-pressure-sensor connecting thread c6 is connected with the sealed-rubber-bag connecting thread c4 and forms a complete sealed space with the sealed rubber bag c7. A wire c5 at an upper end of the film pressure sensor c8 extends through the film-pressure-sensor connecting thread c6, through the fourth component of the probe 5, and through the static cone penetration rod 6, toward a pressure sensor control device 1 on the ground and is connected to the pressure sensor control device 1. The function of the third component of the probe 5 is to connect the first component and the fourth component of the probe 5, store water and gas entering the probe 5, and measure ambient pressure through the film pressure sensor c8 to obtain the gas pressure value in the gas-bearing soil layer 4.

Figure 6:
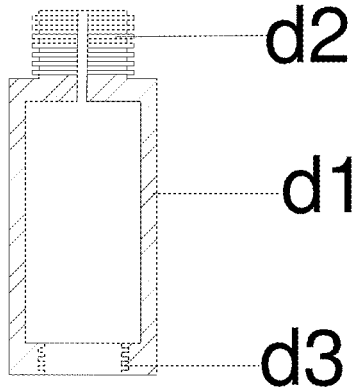
FIG. 6 is a schematic view of a construction of a fourth part of a probe employed in the present disclosure.

Referring to FIG. 6, the fourth component of the probe 5 includes a second probe outer shell d1, a drill-rod connecting thread d2 and a fourth thread d3. An inside of the second probe outer shell d1 of the fourth component of the probe 5 is a hollow cavity, and a hole is dug in the drill-rod connecting thread d2 located at an upper end of the fourth component, so that the wire c5 connected the film sensor c8 can conveniently pass through the hole. The fourth thread d3 at the lower end of the second probe outer shell d1 and the third thread c9 at the upper end of the first probe outer shell c2 of the third component of the probe 5 are mutually screwed to each other; and the drill-rod connecting thread d2 at the upper end of the second probe outer shell d1 is screwed to a lower end of the static cone penetration test rod 6. The function of the fourth component of the probe 5 is to connect the third component of the probe 5 with the static cone penetration rod 6.

Referring to FIG. 1, the present disclosure provides a portable in-situ gas pressure measuring device for a shallow gas-bearing stratum based on the portable in-situ gas pressure measuring probe for a shallow gas-bearing stratum, and the portable in-situ gas pressure measuring device for a shallow gas-bearing stratum includes a static cone penetrometer 8 and a pressure-sensor control system 9, besides the portable in-situ gas pressure measuring probe for a shallow gas-bearing stratum.

The static cone penetrometer 8 is arranged on the ground and is used for feeding the probe 5 to the gas-bearing soil layer 4 by using the static cone penetration rod 6. The static cone penetration rod 6 is a tubular body consisted of multiple tube sections; and each section is 2 to 3 meters in length, and an uppermost section of the static cone penetration rod 6 is connected with the static cone penetrometer 8; and a lowermost section of the static cone penetration rod 6 is connected with the probe 5. The wire c5 passes through the static cone penetration rod 6 and is connected to the pressure-sensor control device 1.

The pressure-sensor control system 9 includes the wire c5 and the pressure-sensor control device 1. One end of the wire c5 is connected to the film pressure sensor c8, and another end is connected to the pressure-sensor control device 1. The pressure sensor control device 1 can zero an initial value of the film pressure sensor c8, and a pressure signal received by the film type pressure sensor c8 is transmitted to the pressure-sensor control device 1 via the wire c5.

The present disclosure also provides a method for measuring an in-situ gas pressure of a shallow gas-bearing stratum based on the portable in-situ gas pressure measuring device for a shallow gas-bearing stratum, which includes the following specific steps.

In step 1), the probe 5 is assembled on site. Firstly, the first component and the second component of the probe 5 are obtained; the cylindrical permeable stone b1 of the second component of the probe 5 is sleeved on the porous metal tube a4 of the first component of the probe 5; and the sealing rubber gasket b2 of the second component of the probe 5 is sleeved on the porous metal tube a4 of the first component of the probe 5. Then, the third component of the probe 5 is assembled. Specifically, the wire c5 is connected with the film type pressure sensor c8, the film type pressure sensor c8 is inserted into the sealed rubber bag c7; the film-pressure-sensor connecting thread c6 is connected with the sealed-rubber-bag connecting thread c4 to seal the sealed rubber bag c7; and the sealed-rubber-bag connecting thread c4 is screwed to the first probe outer shell c2 of the third component of the probe 5. The air in the sealed rubber bag c7 is discharged by a vacuum pump, and the sealed rubber bag c7 is filled with mineral oil c3. Afterwards, via the second screw thread c1 at the lower end of the first probe outer shell c2; the third component of the assembled probe 5 is tightly screwed to the first screw thread a3 at the upper end of the porous metal tube a4 in the first component of the probe 5. Finally, the fourth component of the probe 5 is assembled. Specifically, the fourth thread d3 at the lower end of the fourth component of the probe 5 is screwed to the upper end of the first probe outer shell c2 in the third component of the probe 5; the wire c5 connected with the film pressure sensor c8 is passed through the hole reserved in the drill-rod connecting thread d2; and the fourth thread d3 at the upper end of the fourth component of the probe 5 is tightly screwed to the static cone penetration rod 6. Thus, the assembly of probe 5 is completed.

In step 2), the device is assembled. The wire c5 is led out from the interior of the static cone penetration rod 6 and extends to the ground, and the wire c5 is connected with the pressure-sensor control device 1; thus, a static cone penetration test can be ready to start.

In step 3), the gas pressure is measured. After the probe 5 and the static cone penetration rod 6 are installed on the static cone penetrometer 8, the power supply is switched on, the pressure-sensor control device 1 is activated, an initial pressure value $p_0$ is recorded, and then the pressure value is zeroed. A penetration process is started, and a penetration speed of the probe 5 is preferably 1 cm/s to 2 cm/s. The penetration process is stopped when the probe reaches a predetermined gas-bearing soil layer 4. In this case, the soil particles in the gas-bearing soil layer 4 are blocked outside by the cylindrical permeable stone b1, and water and gas in the gas-bearing soil layer 4 enter into the inner cavity of the third component of the probe 5 through the cylindrical permeable stone b1 of the second component of the probe 5 and the circular apertures of the porous metal tube a4 of the first component of the probe 5. When the water and gas do not enter any more, the pressure of the inner cavity of the third component of the probe 5 is equal to the gas pressure of the gas-bearing soil layer 4; the pressure of the gas-water mixture in the inner cavity of the third component of the probe 5 acts on the sealed rubber bag c7; and the pressure is uniformly transmitted to the film pressure sensor c8 via the mineral oil c3. The film pressure sensor c8 detects the gas pressure and the detected pressure signals are continuously transferred to the pressure-sensor control device 1 on the ground via the wire c5 until data on the pressure-sensor control device 1 does not change any more; and at this moment, a pressure value $p_1$ is recorded as an in-situ gas pressure value in the gas-bearing soil layer 4. The penetration and measurement processes in this step are repeated to obtain the in-situ gas pressure value in the gas-bearing soil layer 4 at a next depth.

In step 4), the device is disassembled. After the measurement of gas pressure is finished, the pressure-sensor control device 1 is closed; the static cone penetration rod 6 is retracted section by section via the static cone penetrometer 8; the probe 5 is detached from the static cone penetration rod 6, and the probe 5 and the wire c5 are also detached. The probe 5 and the cylindrical permeable stone b1 is thoroughly cleaned to remove water and gas in the probe 5 and silt in the cylindrical permeable stone b1, and each part is examined for wear. All parts of the device are disassembled, collected and packed, so that the device can be reused when in-situ gas pressure measurement is carried out in next time.

What is claimed is:

1. A portable in-situ gas pressure measuring probe for a shallow gas-bearing stratum, comprising:

a gas collection part; and a gas pressure measuring part which is coaxially connected with and communicates with the gas collection part; wherein the gas collection part comprises a conical head;

a porous metal tube;

a cylindrical permeable stone; and a sealing rubber gasket;

the conical head is connected with the porous metal tube, the cylindrical permeable stone is sleeved on the porous metal tube, the sealing rubber gasket is arranged between a top of the cylindrical permeable stone and the gas pressure measuring part, a side wall of the porous metal tube is provided with circular apertures penetrating through the side wall; the circular apertures communicate with an inner cavity of the gas pressure measuring part through the hollow porous metal tube.

2. The portable in-situ gas pressure measuring probe for a shallow gas-bearing stratum according to claim 1, wherein the gas collection part comprises a first thread arranged at a top of the porous metal tube, the porous metal tube is connected with the gas pressure measuring part via the first thread.

3. The portable in-situ gas pressure measuring probe for a shallow gas-bearing stratum according to claim 1, wherein the gas pressure measuring part comprises: a first probe outer shell; a wire; a sealed rubber bag; and a film sensor; the first probe outer shell is a hollow cavity structure, the sealed rubber bag is arranged in an inner cavity of the first probe outer shell, the inner cavity of the sealed rubber bag is filled with mineral oil, the film sensor is arranged in the inner cavity of the sealed rubber bag and is immersed in the mineral oil, the wire passes through the first probe outer shell and is connected with the film sensor, the first probe outer shell is connected with the gas collection part and communicated with the gas collection part.

4. The portable in-situ gas pressure measuring probe for a shallow gas-bearing stratum according to claim 3, wherein the gas pressure measuring part comprises:

a first probe outer shell;

a wire;

a sealed rubber bag; and a film sensor;

the first probe outer shell is a hollow cavity structure, the sealed rubber bag is arranged in an inner cavity of the first probe outer shell, the inner cavity of the sealed rubber bag is filled with mineral oil, the film sensor is arranged in the inner cavity of the sealed rubber bag and is immersed in the mineral oil, the wire passes through the first probe outer shell and is connected with the film sensor, the first probe outer shell is connected with the gas collection part and communicated with the gas collection part.

5. The portable in-situ gas pressure measuring probe for a shallow gas-bearing stratum according to claim 4, wherein the gas collection part comprises a first thread arranged at a top of the porous metal tube, the gas pressure measuring part comprises a second thread arranged at a bottom of the first probe outer shell, the second thread is connected to the first thread of the gas collection part.

6. The portable in-situ gas pressure measuring probe for a shallow gas-bearing stratum according to claim 4, wherein the gas pressure measuring part comprises a second thread arranged at a bottom of the first probe outer shell, the second thread is connected to the first thread of the gas collection part.

7. The portable in-situ gas pressure measuring probe for a shallow gas-bearing stratum according to claim 5, wherein the gas pressure measuring part comprises a sealed-rubber-bag connecting thread which is arranged at a top of the first probe outer shell and is used for being connected with the sealed rubber bag, and a film-sensor connecting thread connected with the film type sensor, the sealed rubber bag is arranged inside the first probe outer shell via the sealed-rubber-bag connecting thread, the film sensor is arranged at the top of the first probe outer shell via the film-sensor connecting thread and is arranged inside the sealed rubber bag.

8. The portable in-situ gas pressure measuring probe for a shallow gas-bearing stratum according to claim 6, wherein the gas pressure measuring part comprises a sealed-rubber-bag connecting thread which is arranged at a top of the first probe outer shell and is used for being connected with the sealed rubber bag, and a film-sensor connecting thread connected with the film type sensor, the sealed rubber bag is arranged inside the first probe outer shell via the sealed-rubber-bag connecting thread, the film sensor is arranged at the top of the first probe outer shell via the film-sensor connecting thread and is arranged inside the sealed rubber bag.

9. A portable in-situ gas pressure measuring device for a shallow gas-bearing stratum based on the portable in-situ gas pressure measuring probe for a shallow gas-bearing stratum as claimed in claim 7, comprising a static cone penetrometer, a pressure-sensor control system, a static cone penetration rod and the probe, the static cone penetrometer is connected with the static cone penetration rod, the static cone penetration rod is connected with the probe, the probe is connected with the pressure-sensor control system.

10. A portable in-situ gas pressure measuring device for a shallow gas-bearing stratum based on the portable in-situ gas pressure measuring probe for a shallow gas-bearing stratum as claimed in claim 8, comprising a static cone penetrometer, a pressure-sensor control system, a static cone penetration rod and the probe, the static cone penetrometer is connected with the static cone penetration rod, the static cone penetration rod is connected with the probe, the probe is connected with the pressure-sensor control system.

11. The portable in-situ gas pressure measuring device for a shallow gas-bearing stratum as claimed in claim 9, wherein the pressure-sensor control system comprises a pressure-sensor control device and a wire, the probe is connected with the pressure-sensor control device via the wire.

12. The portable in-situ gas pressure measuring device for a shallow gas-bearing stratum as claimed in claim 10, wherein the pressure-sensor control system comprises a pressure-sensor control device and a wire, the probe is connected with the pressure-sensor control device via the wire.

13. The portable in-situ gas pressure measuring device for a shallow gas-bearing stratum as claimed in claim 9, further comprising an adapter part arranged between the gas pressure measuring part and the static cone penetration rod, the adapter part comprises a second probe outer shell, a drill-rod connection thread and a fourth thread, the second probe outer shell is connected with a top of the gas pressure measuring part via the fourth thread, the second probe outer shell is connected with a bottom of the static cone penetration rod via the drill-rod connecting thread.

14. The portable in-situ gas pressure measuring device for a shallow gas-bearing stratum as claimed in claim 10, further comprising an adapter part arranged between the gas pressure measuring part and the static cone penetration rod, the adapter part comprises a second probe outer shell, a drill-rod connection thread and a fourth thread, the second probe outer shell is connected with a top of the gas pressure measuring part via the fourth thread, the second probe outer shell is connected with a bottom of the static cone penetration rod via the drill-rod connecting thread.

15. The portable in-situ gas pressure measuring device for a shallow gas-bearing stratum as claimed in claim 11, further comprising an adapter part arranged between the gas pressure measuring part and the static cone penetration rod, the adapter part comprises a second probe outer shell, a drill-rod connection thread and a fourth thread, the second probe outer shell is connected with a top of the gas pressure measuring part via the fourth thread, the second probe outer shell is connected with a bottom of the static cone penetration rod via the drill-rod connecting thread.

16. The portable in-situ gas pressure measuring device for a shallow gas-bearing stratum as claimed in claim 12, further comprising an adapter part arranged between the gas pressure measuring part and the static cone penetration rod, the adapter part comprises a second probe outer shell, a drill-rod connection thread and a fourth thread, the second probe outer shell is connected with a top of the gas pressure measuring part via the fourth thread, the second probe outer shell is connected with a bottom of the static cone penetration rod via the drill-rod connecting thread.

17. A measuring method based on a portable in-situ gas pressure measuring device for a shallow gas-bearing stratum, comprising:

assembling a probe, comprising:

connecting a porous metal tube with a conical head, sleeving a cylindrical permeable stone on the porous metal tube, sleeving a sealing rubber gasket on the porous metal tube so that the sealing rubber gasket is positioned at a top of the cylindrical permeable stone;

connecting a wire with a film pressure sensor, and inserting the connected film pressure sensor into a sealed rubber bag, fixing the sealed rubber bag and the film pressure sensor inside a first probe outer shell, filling the sealed rubber bag with mineral oil after air in the sealed rubber bag is discharged by a vacuum pump;

connecting the first probe outer shell with the porous metal tube, passing the wire connected with the film pressure sensor through a second probe outer shell, and connecting the first probe outer shell with the second probe outer shell; and connecting the second probe outer shell with a static cone penetration rod, and completing the assembly of the probe;

assembling a measuring part, comprising:

passing the wire through a hollow static cone penetration rod to the ground, and connecting the wire with a pressure-sensor control device, to prepare for a static cone penetration test; and measuring an in-situ gas pressure, comprising:

switching on a power supply after the probe and the static cone penetration rod are installed on a static cone penetrometer, activating the pressure-sensor control device, recording an initial pressure value, and zeroing the pressure value;

penetration operation configured for performing a penetration at a penetration speed of 1 cm/s to 2 cm/s until the probe reach a determined gas-bearing soil layer, wherein soil particles are blocked outside by the cylindrical permeable stone, and water and gas in the gas-bearing soil layer can enter an inner cavity of the first probe outer shell through the cylindrical permeable stone of the probe and circular apertures of the porous metal tube, when the water and gas do not enter any more, a pressure in the inner cavity of the probe is equal to a gas pressure of the gas-bearing soil layer, the pressure of a gas-water mixture in the inner cavity of the probe acts on the sealed rubber bag, and the pressure is uniformly transmitted to the film pressure sensor via the mineral oil;

detection operation configured for detecting and transferring by the film pressure sensor detected pressure signals to the pressure-sensor control device on a ground via the wire until data on the pressure sensor control device do not change any more, and recording a pressure value at this moment, as an in-situ pressure value in the gas-bearing soil layer; and repeating the penetration operation and the detection operation to obtain an another in-situ gas pressure value in another gas-bearing soil layer located at a next depth.

* * * * *